US006080923A

United States Patent [19]

Austin

[11] Patent Number: 6,080,923

[45] Date of Patent: Jun. 27, 2000

[54] REUSABLE LIP GUARD FOR BRASS AND WOODWIND MUSICIANS WHO WEAR BRACES

[76] Inventor: Joel Andrew Austin, 2940 Coventry La., Waukesha, Wis. 53188

[21] Appl. No.: 08/579,313

[22] Filed: Dec. 27, 1995

[51] Int. Cl.[7] ..... G10D 9/02

[52] U.S. Cl. ..... 84/383 R; 84/453; 128/861; 128/862

[58] Field of Search ..... 84/330, 383 R, 84/453; 128/861, 862; 433/2–22

[56] References Cited

U.S. PATENT DOCUMENTS

| | | | |
|---|---|---|---|
| 2,706,478 | 4/1955 | Porter | 128/136 |
| 3,327,580 | 6/1967 | Herweg . | |
| 3,411,501 | 11/1968 | Greenberg . | |
| 3,485,242 | 12/1969 | Greenberg . | |
| 4,482,321 | 11/1984 | Tabor et al. . | |
| 4,559,013 | 12/1985 | Amstutz et al. | 433/22 |
| 4,609,348 | 9/1986 | Rowland . | |
| 4,920,984 | 5/1990 | Furumichi et al. | 128/861 |
| 5,031,638 | 7/1991 | Castaldi . | |
| 5,320,114 | 6/1994 | Kittelsen et al. . | |
| 5,462,066 | 10/1995 | Snyder | 128/848 |
| 5,566,684 | 10/1996 | Wagner | 128/861 |

*Primary Examiner*—Robert E. Nappi
*Assistant Examiner*—Marlon T. Fletcher
*Attorney, Agent, or Firm*—Reinhart, Boerner, Van Deuren, Norris & Rieselbach, s.c.

[57] ABSTRACT

A lip guard is provided for protecting the lips of brass and woodwind players who wear braces. Each lip guard comprises a strip of thermoplastic material that is heated, molded into place over the teeth and braces of the musician, and then allowed to cool. The lip guards thus provide a smooth, protective barrier between the musician's lips and braces that protects the lips against chaffing that might occur as the mouthpiece of a musical instrument presses back against the musician's lips. The lip guards can be removed from the teeth quickly and easily between performances and can be reused from performance to performance. If adjustments are made to the musician's braces, the lip guards can be easily and conveniently reheated and remolded to accomodate the new shape.

17 Claims, 2 Drawing Sheets

REUSABLE LIP GUARD FOR BRASS AND WOODWIND MUSICIANS WHO WEAR BRACES

BACKGROUND OF THE INVENTION

This invention relates generally to mouth guards or lip guards and, more particularly, to lip guards for protecting the lips of brass or woodwind musicians who wear orthodontic braces.

The serious study of music best begins in childhood and continues through adolescence. At no other period can the student learn to play an instrument as easily or readily. This is also the best time, however, to straighten the students teeth should orthodontic work be in order. Thus, it is not uncommon for young musicians to wear orthodontic braces at some point in their musical training. For brass and woodwind players, braces can be a serious impediment. Frequently, the pressure of the lips against the mouthpiece forces the lips back against the braces with sufficient force to cause enough soreness to make further playing painful if not impossible. Few musicians, however, are willing to give up their instrument during the months or years needed to straighten their teeth.

One well-known technique for avoiding this problem is to press wax over the braces behind the lips before each performance. The wax is smoothed and shaped so as to form a smooth, protective barrier over the braces. The lips can then be pressed against the barrier during the performance without causing soreness or rawness. Although effective, this technique has a significant drawback—after the performance, the wax must be removed by more-or-less digging it away from the teeth and braces. This can be a tedious, time consuming, unpleasant task. Furthermore, each performance requires that the whole process of applying the wax, smoothing it out and picking it away at the end of the performance be repeated.

Another known technique for protecting the lips of musicians who wear braces is to form a removable, reusable guard that the musician can insert and remove before and after each performance. The guard can be formed of a moldable plastic material that is cast in place so as to conform to the musician's teeth and mouth. After the plastic sets, the guard can be reused in subsequent performances. Although much more convenient than using wax, this technique requires the services of an orthodontist or other professional who actually does the casting and molding. This requires that an appointment be set up and kept and that the process be repeated every time an adjustment is made to the musician's braces. Although less troublesome than the wax technique, this technique is still not without inconvenience, particularly if the musician misplaces or otherwise loses the guard shortly before an important performance.

In view of the various drawbacks of prior methods and techniques, a need exists for a new way of protecting the lips of braces-bearing musicians that is convenient, effective and inexpensive.

SUMMARY OF THE INVENTION

The invention provides a lip guard for protecting the lips of a braces-wearing musician during performances on a brass or woodwind instrument. The lip guard comprises an elongate segment of a thermoplastic material that has been softened with heat and then pressed over the teeth and braces of the musician while the segment is softened to form a barrier between the musician's lip and the braces. The segment is thereafter allowed to cool and harden and thereby conform to and retain the shape of the musician's teeth and braces.

The invention also provides a method of protecting the lips of a brass or woodwind-playing musician who wears braces against abrasion caused by pressure of the musician's lip against the braces during a performance. The method comprising the steps of providing an elongate segment of a thermoplastic material, heating the segment to soften the thermoplastic material, molding the softened segment of thermoplastic material over the teeth and braces of the musician to form a barrier between the braces and the inner surface of the musician's lip, and, allowing the segment of thermoplastic material to cool while in place over the musician's braces so as to harden the segment of thermoplastic material into a removable, reusable lip guard.

In one embodiment, the thermoplastic material comprises ethylene vinyl acetate copolymer.

In one embodiment, the lip guard can be removed from the musician's teeth after it has cooled and reused from performance to performance.

In one embodiment, the lip guard can be reshaped after an adjustment to the musician's braces by reheating the lip guard and reshaping it to conform to the musician's braces while warm.

In one embodiment, the thermoplastic material is softened by immersing it in warm or hot water.

It is an object of the present invention to provide a musician's lip guard that is convenient and effective in use and economical in manufacture.

It is a further object of the present invention to provide a musician's lip guard that can be easily reused from performance to performance.

It is a further object of the present invention to provide a musician's lip guard that can be reformed as necessary to accommodate adjustments to the musician's braces.

It is a further object of the present invention to provide a musician's lip guard that can be formed and installed by the musician individually without requiring the services of an orthodontic professional.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 3:
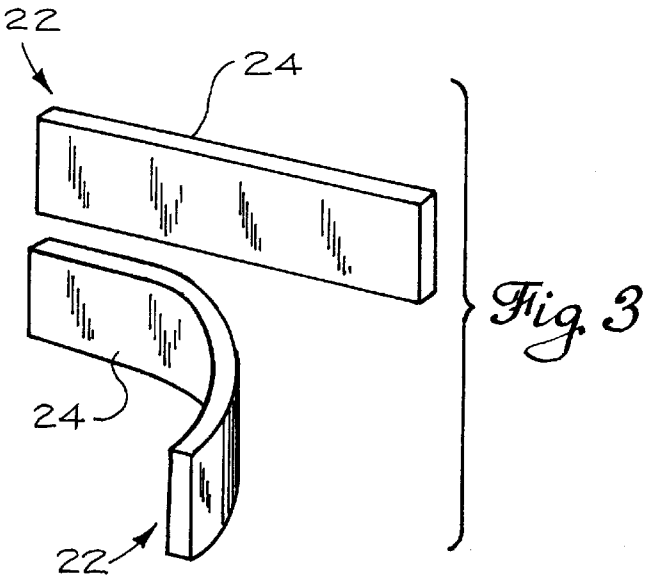
FIG. 3 is a perspective view of a pair of lip guards embodying various features of the invention prior to being molded so as to conform to the shape of the musician's teeth and the braces worn on the musician's teeth.
Figure 2:
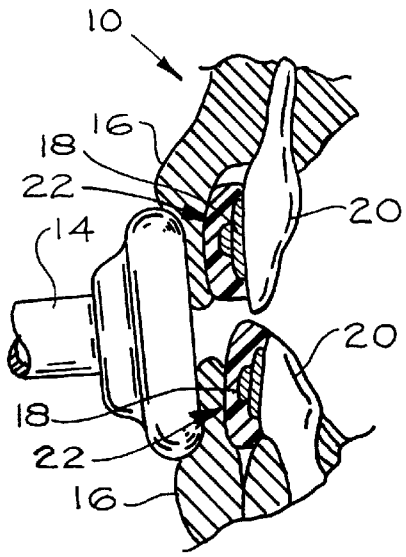
FIG. 2 is a cross-sectional view taken along line 2—2 of FIG. 1 showing orthodontic braces worn by the musician and a pair of lip guards, embodying various features of the invention, positioned over the braces to protect the musician's lips from the braces.
Figure 1:
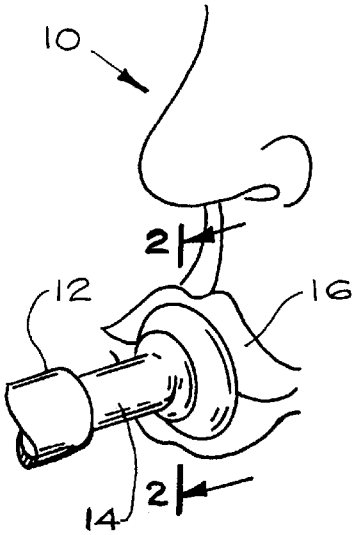
FIG. 1 is a fragmentary perspective view of a musician's lips engaging the mouthpiece of a brass instrument.

FIGS. 1 and 2 of the drawings show a musician 10 playing a brass instrument 12. The instrument 12 includes a mouthpiece 14 that engages the musician's lips 16. As best seen in FIG. 2, the musician wears braces 18 on his teeth 20. As the instrument 12 is played, the mouthpiece 14 presses the musician's lips 16 back against the teeth 20 and the braces 18. The resulting pressure, in combination with the rough surface created by the presence of the braces 18 on the musician's teeth 20, creates the potential for abrading the musician's lips 16 or otherwise causing soreness or discomfort. To avoid this, the musician 10 also wears a pair of lip guards 22 that are made in accordance with, and embody various features of, the invention. The lip guards 22 form a smooth protective barrier between the braces 18 and the inner surfaces of the musician's lips 16.

The lip guards 22 are preferable formed of a thermoplastic material that softens and becomes moldable when heated and that hardens sufficiently to retain its shape, yet remain flexible and resilient, when cooled. Preferable, the material softens sufficiently to become moldable when heated to a range of about 160–212 degrees Farenheit, yet hardens sufficiently to retain its shape at ordinary body temperatures, i.e., 98–100 degrees F. The material should also be non-toxic and compatible with use within a human mouth. One suitable material is ethylene vinyl acetate copolymer manufactured by DuPont under the trademark "Elvax" and utilized by Easy Gard Industries in its "Easy Gard" brand of mouthguard. This material softens at approximately 180 degrees F., is inert and non-toxic, and is well-suited for use on teeth and in the mouth.

Figure 5:
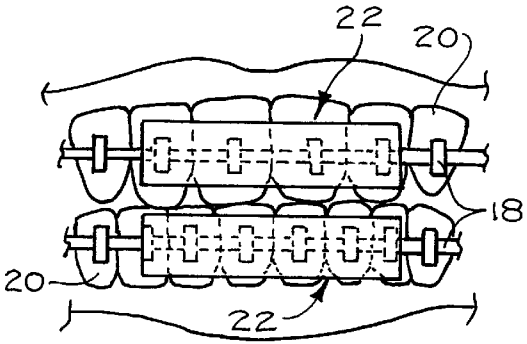
FIG. 5 is a front elevation view of the warmed lip guards being placed over the musician's teeth so as to conform the lip guards to the shape of the musician's teeth and the braces worn thereon.
Figure 4:
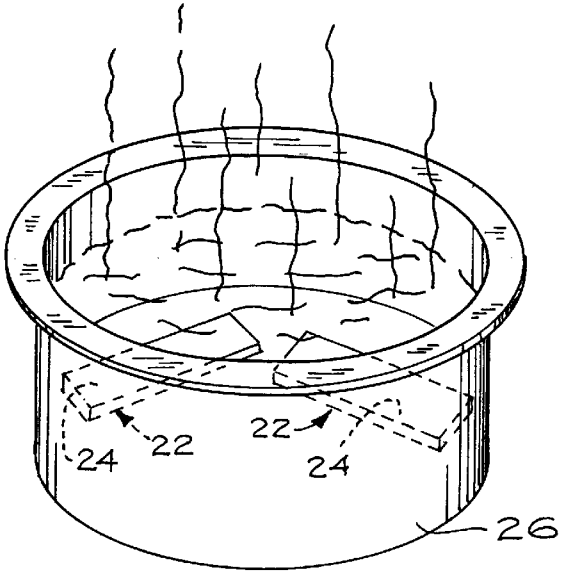
FIG. 4 is a perspective view of the two lip guards being warmed in a container of hot water prior to being molded to conform to the musician's teeth and braces.

Each lip guard 22 initially exists in the form of rectangularly sectioned, elongate stock from which a blank 24 is cut. The length and width of each blank is sufficient to cover the braces 18 on the upper or lower sets of teeth 20, respectively, in the area behind the lips 16 that is likely to be pressed back when the musical instrument 12 is played. After the blanks 24 are cut, they are softened by being placed in a container of hot water 26 (FIG. 4). The water heats the blanks 24 sufficiently to make them moldable or pliable. After such heating, the softened blanks 24 are removed from the container of hot water 26 and are placed, molded and shaped one at a time, over the braces 18 (FIG. 5). The softened blanks 24 mold themselves around the teeth 20 and the braces 18 to form a protective barrier between the braces 18 and the inner surfaces of the musician's lips. The barrier thus formed prevents contact between the braces 18 and the inner surfaces of the musician's lips 16 to avoid discomfort while the musician 10 plays. The outer surface of each blank 24 can be shaped and smoothed, preferably by the musician 10 rubbing a finger over the surface, to form a smooth, regular surface that further enhances the musician's comfort while playing. The blanks 24 are then allowed to cool in place to form the lip guards 22. Although in the embodiment illustrated the blanks are of rectangular shape and section, it will be appreciated that stock having a rounded or oval section could also be used, and it will further be appreciated that the blanks 24 can be cut with rounded corners, rather than the square comers illustrated.

Figure 6:
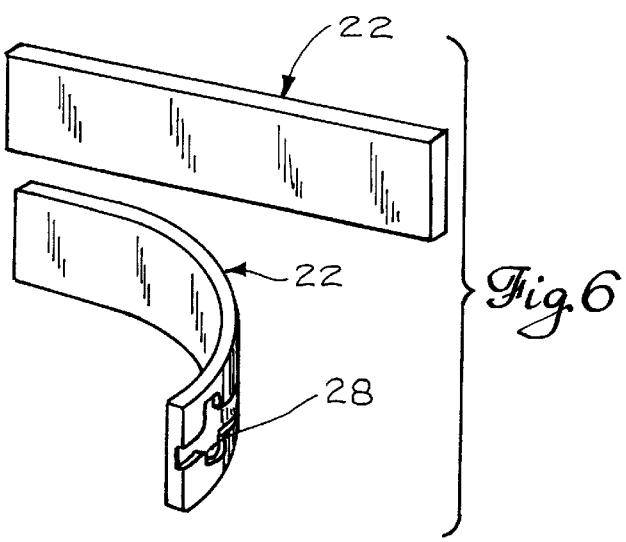
FIG. 6 is a perspective view of the lip guards after molding showing how the lip guards conform to the shape of the musician's teeth and braces after the guards have cooled.

After the lip guards 22 cool, they can be peeled from the musician's teeth 20 as shown in FIG. 6. The now-cooled lip guards 22 retain the shapes they aquired while being molded and contain an impression 28 of the musician's teeth 20 and braces 18. The lip guards 22 can be removed from the teeth 20 between performances and reused over and over. To re-install the lip guards 22, they are simply placed over the teeth and pressed until the braces 18 snap into the impressions 28 that were formed when the lip guards 22 were initially molded. The braces 18 thus engage the impressions 28 to secure and lock the lip guards 22 to the teeth 20.

From time to time, adjustments may be made to the braces 18 that change their shape and orientation on the teeth 20. Also, as the braces 18 do their work, the orientation of the musician's teeth 20 relative to each other changes. Both circumstances limit the useful life of a set of lip guards 22. It is usually necessary to make a new set of lip guards 22 following any significant change in the musician's teeth 20 or braces 18. Although a change in the lip guards 22 may be necessary, this does not mean that the existing set of lip guards 22 must be discarded. Rather, it is possible to remold an existing set of lip guards 22 simply by reheating the guards in hot water and remolding them to the current shape of the musician's teeth 20 and braces 18. Alternatively, given the relative simplicity with which the lip guards 22 are formed and the low cost of the materials involved, it is practical simply to make a new set of lip guards 22 from fresh stock whenever the guards are needed or whenever significant changes occur in the musician's teeth 20 or braces 18.

The invention provides many advantages over existing devices and methods for protecting the lips of brass and woodwind players who wear braces. The lip guards 22 provided by the invention are effective, convenient and low cost. Furthermore, the inventive method can be practiced by the musician himself, thereby minimizing the expense and inconvenience of seeking professional services. After the lip guards 22 are molded, they can be carried along by the musician so that they are ready to go into place at a moments notice. Following the performance, the lip guards 22 can be removed easily without the hassle of trying to remove wax from between the teeth and around the braces. Finally, in the event adjustments are made to the braces, the lip guards 22 can be easily and quickly remolded by the musician to accomodate the new shape. Alternatively, an entirely new set of guards can be molded, easily and economically, from new stock.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A lip guard for protecting the lips of a braces-wearing musician during performances on a brass or woodwind instrument, said lip guard comprising;

an elongate, substantially flat segment of thermoplastic material which may be softened with heat and shaped solely over front surfaces of the musician's incisors and over braces attached thereto on one of the musician's upper and lower jaws while said segment is softened to thereby form a barrier between the musician's lip and braces;

said segment of thermoplastic material being of a size to substantially cover front surfaces of at least the musician's four incisor teeth and braces attached thereto on the one of the musician's upper and lower jaws while leaving back surfaces and bottom surfaces of the musician's teeth on the one of the musician's upper and lower jaws free from obstruction, said segment of thermoplastic material when cooled hardening and thereby conforming to and retaining the shape of the musician's teeth and braces on the one of the musician's upper and lower jaws until such time as the shape of the musician's teeth and braces change to define a new shape of the musician's teeth and braces;

said segment of thermoplastic material accepting and conforming to the new shape of the musician's teeth and braces on the one of the musician's upper and lower jaws upon re-application of heat to the segment of thermoplastic material; and said segment of thermoplastic material having a softening point and being moldable and remoldable at temperatures substantially between 160 and 212 degrees Fahrenheit.

2. A lip guard as defined in claim 1 wherein said thermoplastic material comprises ethylene vinyl acetate copolymer.

3. A lip guard as defined in claim 1 wherein said segment is cut from a stock source of said thermoplastic material.

4. A lip guard as defined in claim 3 wherein said stock is of substantially rectangular section.

5. A method of protecting the lips of a brass or woodwind-playing musician who wears braces against abrasion caused by pressure of the musician's lip against the braces during a performance, said method comprising the steps of:

providing an elongate, substantially flat segment of a thermoplastic material;

heating said segment of thermoplastic material to a temperature substantially between 160 and 212 degrees Fahrenheit to soften said segment of thermoplastic material;

molding said softened segment of thermoplastic material solely over front surfaces of at least four of the musician's teeth on one of the musician's upper and lower jaws and over braces attached thereto while leaving all other teeth surfaces free from contact with said segment of thermoplastic material to thereby form a barrier between the braces and the inner surface of the musician's teeth free from obstruction;

allowing said segment of thermoplastic material to cool while in place over the musician's teeth and braces on the one of the musician's upper and lower jaws so as to harden said segment of thermoplastic material into a removable, reusable lip guard;

if necessary, re-heating said segment to a temperature substantially between 160 and 212 degrees Fahrenheit to soften said segment of thermoplastic material following any movement of the musician's braces and teeth; and reshaping said lip guard to conform to the teeth and the braces of the musician following the movement.

6. A method as defined in claim 5 comprising the additional step of removing said lip guard from the musician' teeth after said thermoplastic material has cooled.

7. A method as defined in claim 6 comprising the additional step of installing said lip guard over the braces of the musician before a performance and removing said lip guard after the performance.

8. A method as defined in claim 7 comprising the additional step of reshaping said lip guard to conform to the teeth and braces of the musician following an adjustment to the musician's braces.

9. A method as defined in claim 5 wherein said additional step of reshaping said lip guard comprises the additional steps of heating said lip guard to soften said thermoplastic material, pressing said heated lip guard over the braces of the musician to conform said heated lip guard to the musician's braces and thereafter allowing said heated lip guard to cool.

10. A method for protecting the lips of a wind instrument player, comprising the steps of:

providing a flat, substantially rectangular segment of thermoplastic material;

heating said segment of thermoplastic material to a softened state substantially within a temperature range of between 160 and 212 degrees Fahrenheit;

applying said segment to front surfaces of said player's four incisors and braces attached thereto on one of said player's upper and lower jaws;

applying pressure to said segment of thermoplastic material while in the softened state to conform said segment of thermoplastic material to a shape of said player's incisors and braces attached thereto on the one of said player's upper and lower jaws, while leaving back surfaces and bottom surfaces of said player's incisors free from obstruction;

cooling said segment;

removing said segment from front surfaces of said player's incisors and braces attached thereto; and re-heating and re-applying said segment to a new shape of said player's front incisors and braces attached thereto on the one of said player's upper and lower jaws while leaving the back surfaces and bottom surfaces of said player's incisors free from obstruction following an adjustment to said player's braces.

11. The method as claimed in claim 10, further comprising the steps of:

cooling the segment; and removing the segment from the front surface of the player's teeth and braces attached thereto.

12. The method as claimed in claim 11, wherein the thermoplastic material comprises ethylene vinyl acetate copolymer.

13. The method as claimed in claim 11, wherein the segment of thermoplastic material originally has a substantially rectangularly shaped profile.

14. The method as claimed in claim 10, further comprising the following steps performed prior to cooling the segment:

smoothing an outer surface and edges of the segment of thermoplastic material to conform the outer surface and edges to a space between the lips and teeth of the player.

15. A lip guard that aids a musician wearing braces when playing a brass or woodwind instrument comprising:

an elongate, flat, substantially rectangular segment of thermoplastic material having a length to substantially cover said musician's incisors and canines and braces attached thereto on one of said musician's upper and lower jaws and having a width to substantially cover frontal surfaces of said musician's incisors and canines with braces attached thereto on the one of said musician's upper or lower jaws while leaving bottom surfaces and back surfaces of incisors and canines free from contact with said segment of thermoplastic material;

wherein said segment of thermoplastic material may be softened with heat between substantially 160 degrees to 212 degrees Fahrenheit and shaped over and conforming to said musician's incisors and canines and braces attached thereto to thereby form a barrier between said musician's lips and incisors and canines and braces attached thereto;

said segment of thermoplastic material when cooled hardening and retaining said shape of incisors and braces attached thereto; and wherein upon a change in position of said musician's incisors and canines and braces attached thereto, said segment of thermoplastic material when again softened by heat may be conformed to and shaped the new position of to incisors and braces attached thereto.

16. A lip guard as defined in claim 15 wherein said segment of thermoplastic material is cut from a bulk supply of thermoplastic stripping.

17. A lip guard as defined in claim 15 wherein said segment of thermoplastic material has a thickness no greater than the distance said braces project from said musician's teeth.

* * * * *